US008497819B2

(12) United States Patent
Hoppenbrouwers et al.

(10) Patent No.: US 8,497,819 B2
(45) Date of Patent: Jul. 30, 2013

(54) ELECTROLUMINESCENT DISPLAY DEVICES

(75) Inventors: Jurgen J. L. Hoppenbrouwers, Eindhoven (NL); Franciscus P. M. Budzelaar, Eindhoven (NL); Nijs C. Van Der Vaart, Rosmalen (NL)

(73) Assignee: Koninklijke Electronics N.V., Eindhoven (NL)

( * ) Notice: Subject to any disclaimer, the term of this patent is extended or adjusted under 35 U.S.C. 154(b) by 554 days.

(21) Appl. No.: 10/572,866

(22) PCT Filed: Oct. 5, 2004

(86) PCT No.: PCT/IB2004/051975

§ 371 (c)(1),
(2), (4) Date: Apr. 5, 2006

(87) PCT Pub. No.: WO2005/036516

PCT Pub. Date: Apr. 21, 2005

(65) Prior Publication Data

US 2007/0008250 A1 Jan. 11, 2007

(30) Foreign Application Priority Data

Oct. 10, 2003 (GB) ..... 0323767.4

(51) Int. Cl.
*G09G 3/30* (2006.01)

(52) U.S. Cl.
USPC ..... 345/76; 345/82; 345/204; 315/169.3; 313/463; 715/784; 715/830

(58) Field of Classification Search
USPC ..... 345/76–83, 36, 45, 204; 315/169.3; 313/463; 715/784–787, 830
See application file for complete search history.

(56) References Cited

U.S. PATENT DOCUMENTS

| | | | | |
|---|---|---|---|---|
| 4,903,013 | A * | 2/1990 | Takeda | 345/686 |
| 6,285,346 | B1 | 9/2001 | Melnik et al. | |
| 6,448,951 | B1 | 9/2002 | Sakaguchi et al. | |

(Continued)

FOREIGN PATENT DOCUMENTS

| | | | |
|---|---|---|---|
| EP | 0574810 | A1 | 12/1993 |
| EP | 0708553 | A2 | 4/1996 |
| JP | 08202310 | A | 8/1996 |
| JP | 09190162 | A | 7/1997 |

OTHER PUBLICATIONS

International Search Report of International Application No. PCT/IB2004/051975 Contained in International Publication No. WO2005036516.

(Continued)

*Primary Examiner* — Lun-Yi Lao
*Assistant Examiner* — Insa Sadio

(57) ABSTRACT

In an active matrix electroluminescent display, a plurality of rows of pixels are illuminated, defining at least two bands of rows separated by a non-illuminated band. The bands of rows of pixels scroll in the column direction over time, and at most 75% of the rows are illuminated at any point in time. This method is in essence a double bar scrolling method. By scrolling two bars, the required peak brightness is reduced as the effective overall duty cycle is increased. However, the period of illumination can still remain short, so that motion perception remains improved. The scrolling speed can be halved for the same frame rate or else the frame rate can be increased to reduce flicker.

11 Claims, 7 Drawing Sheets

U.S. PATENT DOCUMENTS

| | | | | |
|---|---|---|---|---|
| 6,583,775 | B1 | 6/2003 | Sekiya et al. | |
| 7,034,816 | B2 * | 4/2006 | Yatabe | 345/213 |
| 7,176,908 | B2 * | 2/2007 | Matsubara et al. | 345/204 |
| 7,239,742 | B2 * | 7/2007 | Ohtani et al. | 382/162 |
| 7,379,041 | B2 * | 5/2008 | Knee et al. | 345/88 |
| 7,916,099 | B2 * | 3/2011 | Steer et al. | 345/76 |
| 2001/0033278 | A1 * | 10/2001 | Ohta et al. | 345/204 |
| 2002/0126107 | A1 * | 9/2002 | Inoue et al. | 345/204 |
| 2002/0135312 | A1 | 9/2002 | Koyama | |
| 2002/0196241 | A1 * | 12/2002 | Morita | 345/204 |
| 2003/0197472 | A1 * | 10/2003 | Kanauchi et al. | 315/169.1 |
| 2007/0008250 | A1 * | 1/2007 | Hoppenbrouwers et al. | 345/76 |

OTHER PUBLICATIONS

Written Opinion of the International Searching Authority for International Publication No. PCT/IB2004/051975.

* cited by examiner

ELECTROLUMINESCENT DISPLAY DEVICES

This invention relates to electroluminescent display devices, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support.

LED displays (both polymer-type and small-molecule) provide a number of well-known benefits over existing commercialised flat-panel screen technologies such as LCD. These advantages include better viewing angle, faster intrinsic response time (better motion-picture performance), lighter-weight, lower power consumption and cheaper production costs.

Passive matrix displays illuminate one row of pixels at a time, with resulting very high peak brightness, and large voltage swings. Power losses increase exponentially with display diagonal, and such displays become impractical with existing materials beyond around 8 cm diagonal. Active matrix technology places a memory element in each pixel, enabling rows of pixels to be addressed with a data voltage which programs the pixel current flow for the whole frame period.

A display in which all the pixels emit light continuously (such as the simple active matrix scheme described above), leads to a problem which is sometimes overlooked. If an observer watches a moving image on the screen, owing to their eye-tracking the motion and integrating the light received, a type of motion blur results. It is known that reducing the display duty cycle (e.g. to 25%) greatly reduces this form of image impairment.

One demonstrated means of achieving this duty cycle reduction in an LCD is to strobe the whole backlight. A comparable technique could be applied to active matrix OLED displays; first the field luminance data is programmed, then the whole display is "flashed" (either by switching the common cathode, the power rail, or some in-pixel transistors), before the next field is programmed.

The resulting images are much sharper. Flashing may introduce field flicker as a side effect, but this can be suppressed by making the flash frequency high enough. In an LCD, the switching on and off of the image is performed by the backlight. The LCD itself is not fast enough for this.

New LED displays do not exhibit this slow response, and the light switching can thus be performed by the pixel cells themselves, allowing a very flexible control of the way the image is created at a very low cost. Pixels can be programmed to generate a specific amount of light, and can be programmed again to switch off, thus creating a scheme in which light is generated with a certain duty cycle.

A known addressing scheme is the 'address & flash' scheme where the raster time is divided in two periods: an address period in which every line is programmed with the image information, but no light is generated; and a period in which no addressing takes place, and the display is generating light.

In an active-matrix OLED-type display there are two principal disadvantages of "flashing" the whole screen in this way: the time available for addressing the display is reduced to the frame-rate less the "flash" period (and, particularly in high resolution displays, you need as much time as possible for the addressing), and also, due to leakage, the brightness or contrast characteristics of the image in the most recently-addressed part of the display (typically the bottom) are likely to differ from that part first addressed (e.g. the top).

A "scrolling" method of illumination has also been proposed, whereby lines are addressed sequentially in a conventional way, then are illuminated for n line-times (the line-time being the time to address one row of pixels) after addressing. In this way, the portion of the screen illuminated at any instant in time is for example one quarter (25% duty cycle) of the screen, immediately trailing the line being addressed. This method ensures that every line is illuminated for the same time after addressing.

U.S. Pat. No. 6,583,775 discloses a drive scheme in which rows are addressed in turn, but they are turned off before the end of the field period, to provide brightness control in the manner described above.

FIG. 2 shows these different known drive schemes. The scrolling technique shown has been demonstrated on LCDs with segmented, and sequentially illuminated, backlights. In a scrolling bar scheme, each line is addressed twice—once to turn the pixels on and again to turn the pixels off. In this way, the duty cycle can be controlled easily by adjusting the time between these two addressing steps. The height of the bar indicates the size of the duty cycle. This addressing scheme has several technological advantages and is very flexible.

FIG. 3 shows the temporal light distribution as "seen" by each line for the scrolling bar scheme, clearly showing a repetition rate of the frame period $T_f$. Depending on the value of $T_f$, large area flicker will be visible, especially when the duty cycle has a low value. This will certainly be the case when a 50 Hz frame rate is chosen. One obvious solution is to chose a $T_f$ value, such that large area flicker is not observed. However, this implicates frame rate conversion, which will result in motion artefacts such as halos.

The current that generates the light in each pixel of the LED display is supplied via a power supply line. Because this line has a resistance and current is flowing to the pixels, a voltage drop will occur, which can result in cross-talk. Furthermore, the voltage must be at least equal to the voltage across the driving transistor and the LED-diode. This will especially be a problem for large displays.

FIG. 4 shows how the power line voltage drops have an effect which depends on the screen size and duty cycle of the scrolling scheme. The graphs show the maximum voltage drop along a power supply line for varying screen sizes and duty cycles assuming a uniform white image. For large screen sizes and low duty cycles, the results show how power line voltage drops are a problem, as a typical value for the power supply voltage is 15V.

These graphs assume a constant light output is required. As the duty cycle is reduced, the brightness required during illumination is higher to achieve the given brightness, and this requires higher currents and therefore larger voltage drops. FIG. 4A shows the voltage drop vs. screen size at a duty cycle of 50% and FIG. 4B shows the voltage drop vs. duty cycle at a screen size of 30 inches (75 cm).

According to the invention, there is provided a method of illuminating an active matrix electroluminescent display device comprising an array of display pixels arranged in rows and columns, the method comprising, at any point in time, illuminating a plurality of rows of pixels, the plurality of rows defining at least two bands of rows separated by a non-illuminated band, the at least two bands of rows of pixels scrolling in the column direction over time, and wherein at most 75% of the rows are illuminated at any point in time.

This method is in essence a double bar scrolling method. By scrolling two bars, the required peak brightness is reduced as the effective overall duty cycle is increased. However, the period of illumination can still remain short, in particular a duty cycle of less than 75%, so that motion perception remains improved. The scrolling speed can be halved for the same frame rate or else the frame rate can be increased to reduce flicker.

Each band of rows of pixels may comprise a plurality of adjacent rows of pixels. Image data for different frames of the image can then be displayed in the different bands, so that different parts of two adjacent frames are displayed at any one time.

In a preferred implementation, each band of rows of pixels comprises a plurality of sequential alternate rows of pixels. This enables an interlaced scheme to be implemented, by which only odd or even rows appear in a band. In this way, two scrolling operations are required to display a frame of data—one for the odd rows and one for the even rows. This is a preferred implementation particularly when the image data is in interlaced format (i.e. each frame consists of two subsequent fields, one containing only the even lines, one containing only the odd lines, and the contents of the fields are temporally separated by one field time). A true deinterlacer is then not needed.

This results in a doubling of the flashing rate for each region of the display.

The invention also provides an active matrix electroluminescent display device comprising an array of display pixels arranged in rows and columns, and row driver circuitry for illuminating a plurality of rows of pixels simultaneously at each, the plurality of rows defining at least two bands of rows separated by non-illuminated bands, wherein the row driver circuitry comprises means for illuminating each row for at most 75% of the frame period, such that the illuminated rows define at least two bands of rows of pixels which scroll in the column direction over time.

In order to enable the image data to be reformatted into the multiple scroll bar format, a frame buffer is preferably provided for storing image data. The frame buffer only needs to store an amount of data corresponding to a single frame of image data. Data can then be written into the frame buffer progressively frame by frame in sequence, such the frame buffer stores partial data for two adjacent frames, and data can be read out from the frame buffer at two locations simultaneously. These two locations then provide image data for the two scroll bars.

The two locations thus preferably contain data from different adjacent frames of image data.

Examples of the invention will now be described in detail with reference to the accompanying drawings, in which.

Figure 12:
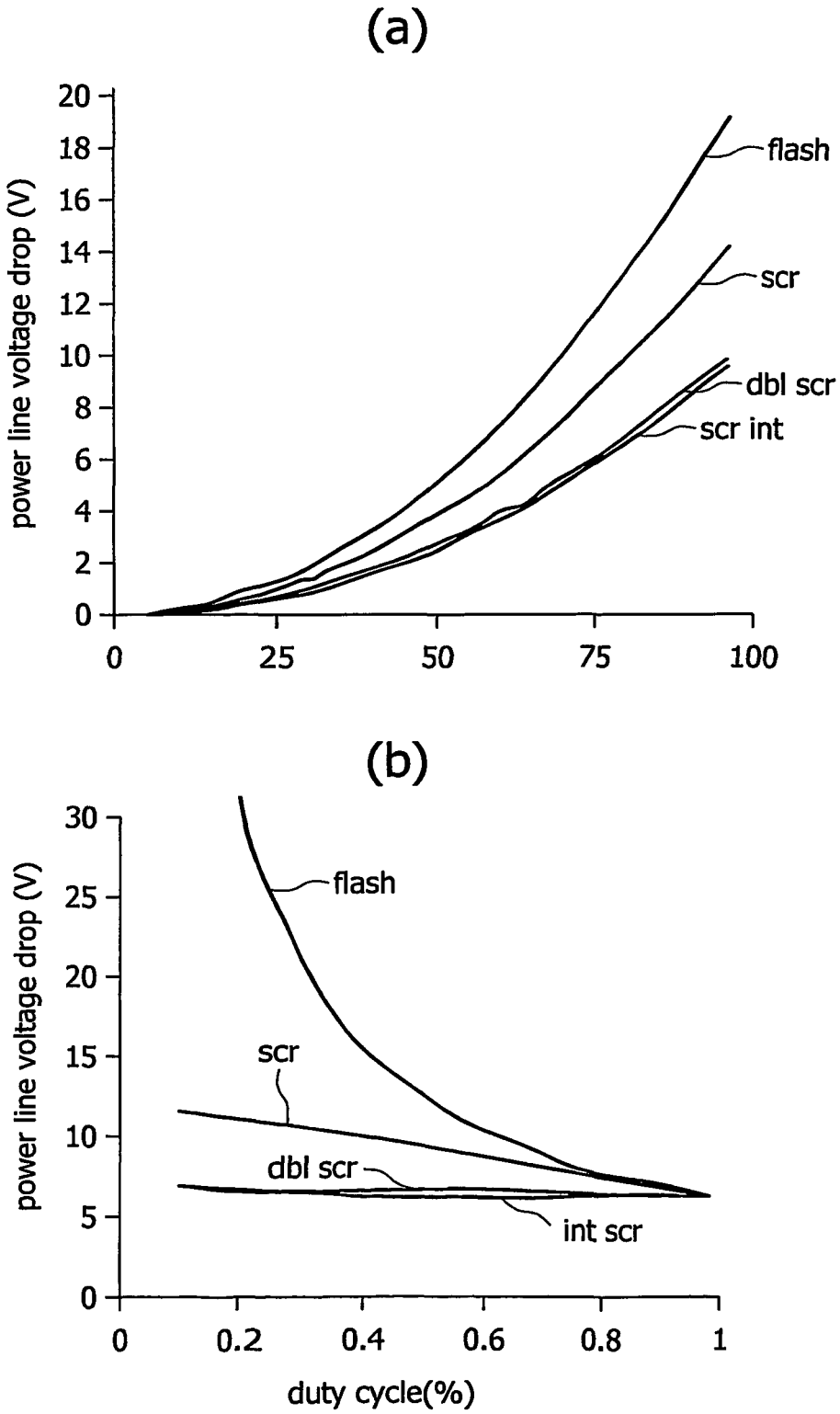
Figure 13:
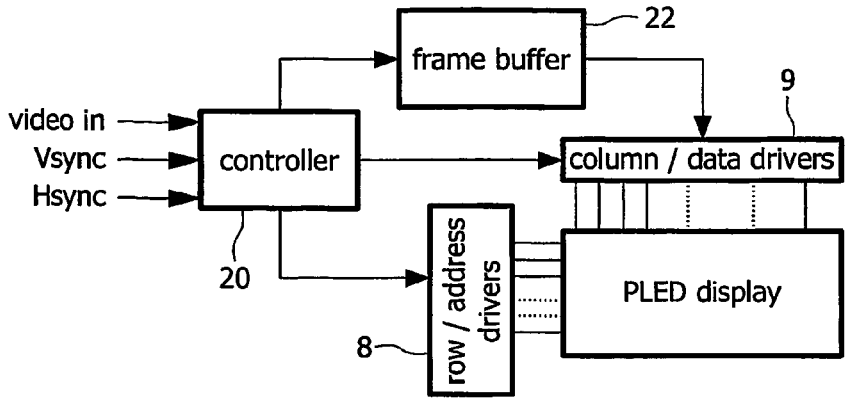
Figure 14:
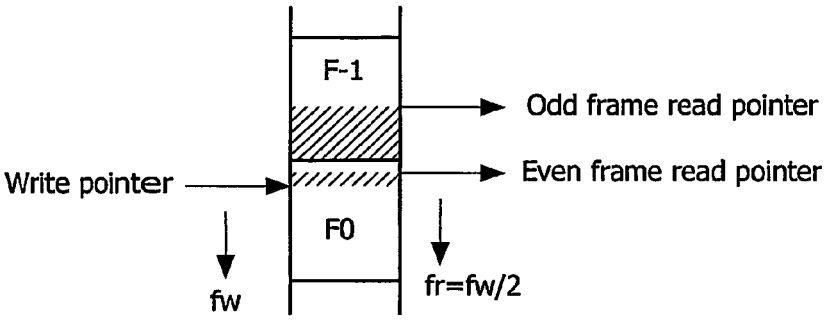
Figure 15:
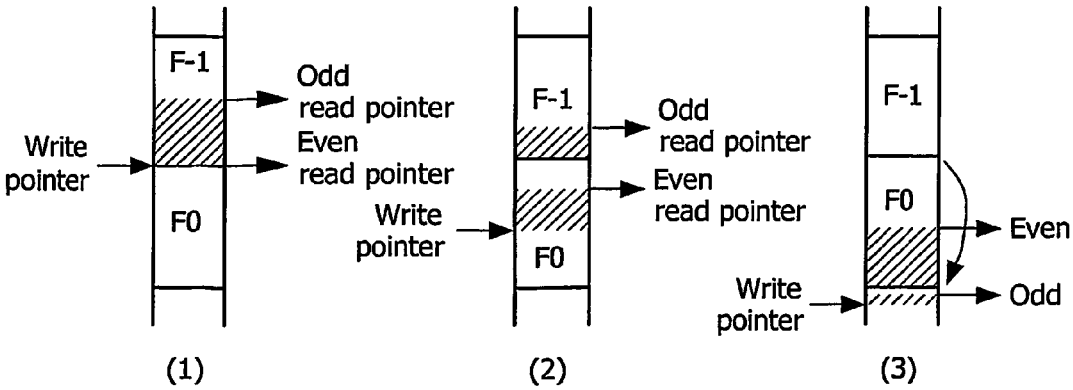

FIGS. 12(*a*) and 12(*b*) are graphs used to explain further the benefits of the techniques of the invention;

FIG. 13 shows a display of the invention for implementing the method of the invention;

FIG. 14 shows a preferred structure of the frame buffer used in FIG. 13; and FIG. 15 is used to explain the operation of the frame buffer.

The invention provides a double bar scrolling addressing scheme. By scrolling two bars, the required peak brightness is reduced as the effective overall duty cycle is increased. Furthermore, the rows that generate light are better distributed over the display. Both factors reduce problems associated with row conductor resistance. However, the period of illumination for each row remains short to give good motion rendition.

Figure 1:
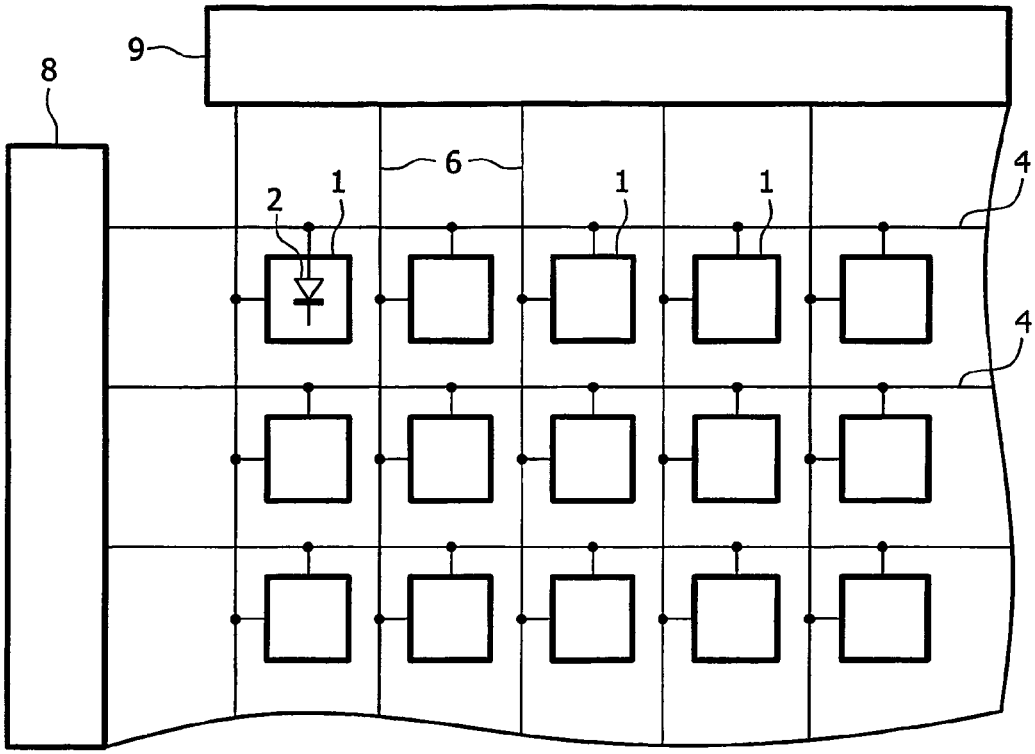
FIG. 1 PRIOR ART
FIG. 1 shows a conventional LED display.
Figure 2:
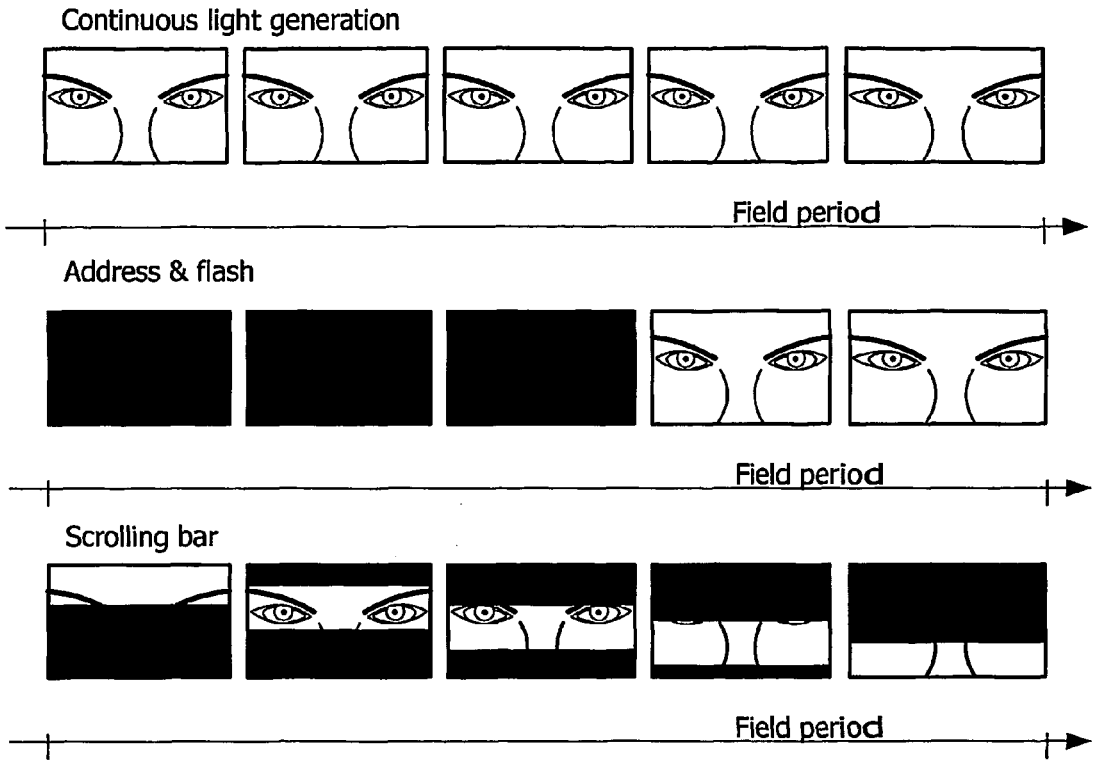
FIG. 2 shows a number of known addressing techniques.
Figure 3:
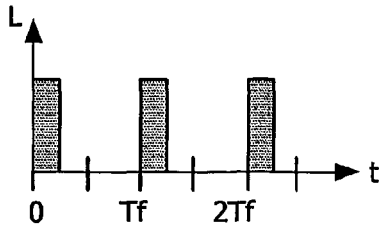
FIG. 3 shows the timing of light output for a row of pixel in the scrolling bar system of FIG. 2.
Figure 4:
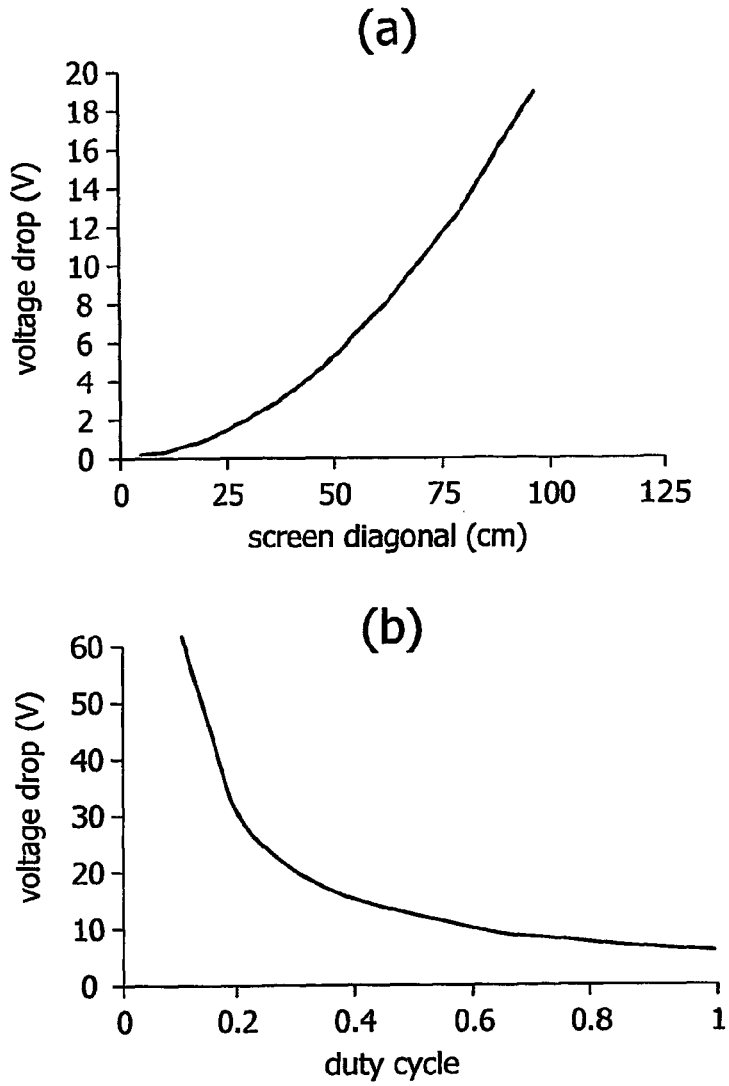
FIG. 4 is used to explain problems associated with the scrolling bar scheme.
Figure 5:
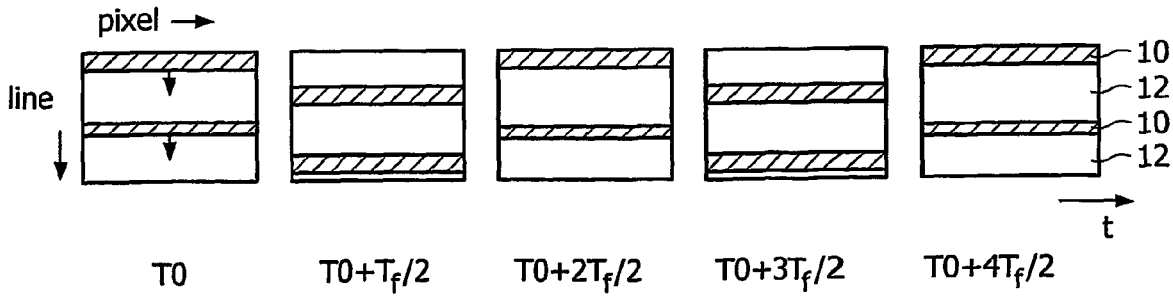
FIG. 5 shows a first addressing technique of the invention.

FIG. 5 shows an addressing scheme of the invention with two scrolling bars 10. There is a non-illuminated band 12 between the illuminated bands 10 of rows. The hatched bars show the rows which are illuminated at a particular point in time, and five sequential times are illustrated covering two frame periods. Light is emitted from the display in two bars, separated by half the screen height. The two bars scroll at the same speed. As it is not possible to address the two rows of the two bars truly simultaneously, the rows are addressed in an alternating way.

Pixel circuits are known which allow the display element to be turned on and off within the frame period. For example, pixel circuits are known which include threshold voltage measurement circuitry to enable compensation of changes in the threshold voltage of the drive transistor. Some examples of these circuits include interrupt switches which are used for the threshold measurement operation, but also enable the display element to be turned off after addressing and before the end of the frame period.

Various pixel designs will be known to those skilled in the art and which enable the display element to be turned off, and these pixel circuits will not be described in this application.

When compared to the single bar scrolling system, there are several additional possibilities.

If the frame rate is kept constant, the bars will scroll with lower speed whilst the number of addressing actions will remain identical. This is shown in FIG. 5.

Alternatively, the frame rate can be doubled to reduce large area flicker, and the bars will then scroll with the same speed, but the number of addressing steps is also doubled.

Figure 6:
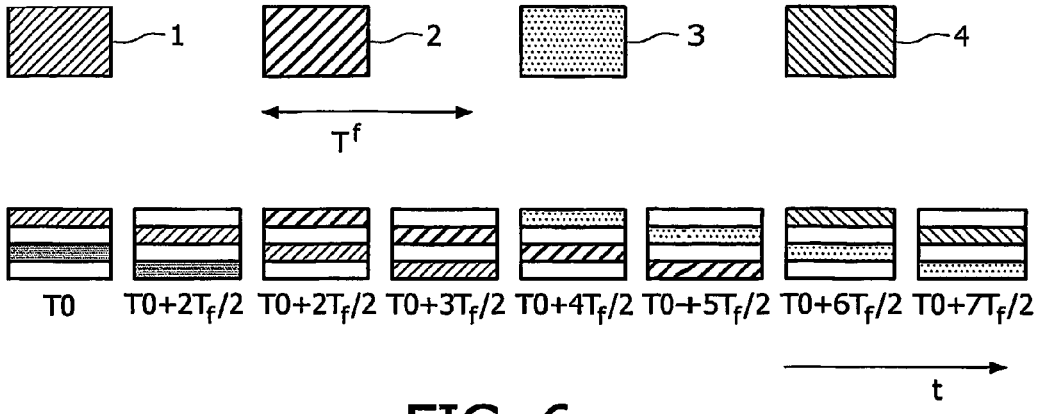
FIG. 6 is used to explain the technique of FIG. 5 in more detail.

In both cases, the bars will display video from subsequent image frames as shown in FIG. 6, which illustrates the relation between input video frames (numbered 1 to 4), the displaying of these images and the frame rate. The duty cycle in the example shown (the percentage of lines generating light at a certain time) is 50%.

As shown, image data for different frames of the image to be displayed is displayed in the different bands. Thus, each image is displayed row-by-row from top to bottom, but at the same time that a different image (the previous frame or the next frame) is also being displayed.

It is desirable to double the frame rate as this increases the flashing frequency. Typically the number of addressing actions must be doubled if the frame rate to be doubled.

Figure 7:
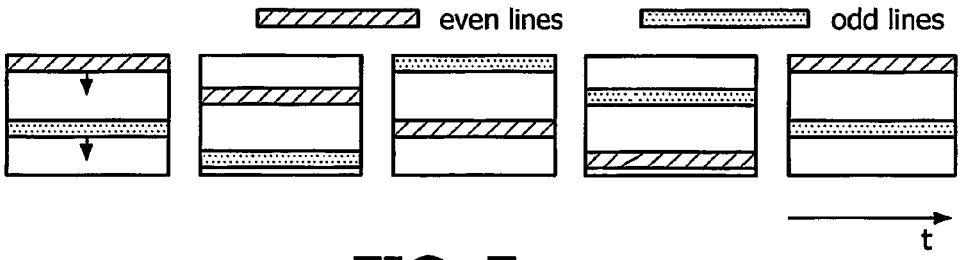
FIG. 7 shows a second addressing technique of the invention.

An interlaced double scrolling bar scheme can be used to enable the flashing frequency to be doubled whilst maintaining the number of addressing actions constant. This is particularly useful when the data source is in an interlaced format. This technique will not typically be used for normal progressive data, as it would result in half the information being discarded and one frame would be separated into two subsequent fields that are temporally separated by half a frame time. This results in double edges for moving objects, unless motion compensation is used. This scheme is illustrated in FIG. 7.

Again, two bars scroll over the screen, but one contains only odd lines while the other contains only even lines. FIG. 7 shows the scrolling of two bands of rows, one containing odd rows and the other containing even rows.

Within one frame period (which corresponds to 4 of the images in FIG. 7) each region of the display is flashed twice. For example a band of rows at the top of the display is flashed at the beginning with even rows (the first image) and again half a frame period later with odd rows (the third image).

In order to avoid motion artefacts, the video displayed in one of the bars should be corrected for motion.

Figure 8:
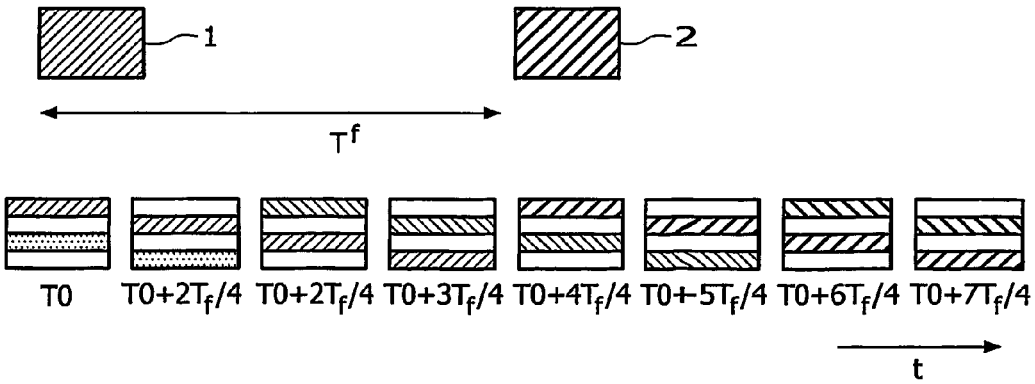
FIG. 8 is used to explain the technique of FIG. 7 in more detail.

FIG. 8 shows how successive frames are displayed with this interlaced double bar scheme, and shows the relation between input video frames, the displaying of these images and the frame rate.

Image information for one frame is hatched diagonally with faint hatching, in one diagonal direction for odd rows and in the other diagonal direction for even rows. Image information for the next frame is hatched diagonally with dark hatching, again in one diagonal direction for odd rows and in the other diagonal direction for even rows.

At any time, odd and even rows for the same image are being displayed, or else odd rows from one frame and even rows for an adjacent frame.

The duty cycle in this example is reduced to 25%, because in a bar only half the number of lines generate light.

Figure 9:
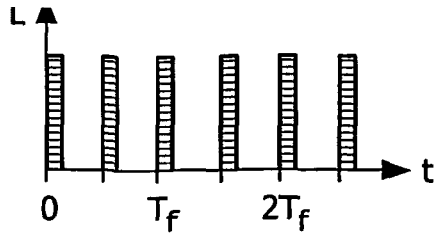
FIG. 9 shows the timing of light output for a row of pixel in the scrolling bar system of FIG. 8.

When the light that is emitted by the display is averaged for several adjacent lines, a temporal response as shown in FIG. 9 is obtained.

For the human eye, the temporal refresh rate is doubled and large area flicker is reduced, while the number of addressing actions remains constant.

Figure 10:
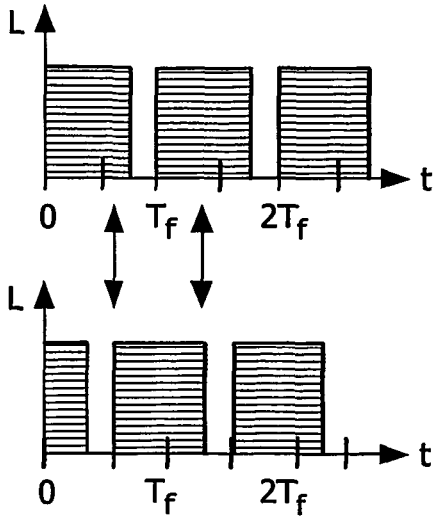
FIG. 10 is used to show the limits of the technique of FIG. 8.

For duty cycles approaching 50%, strange motion artefacts (perceived as so-called "fish bone" structures) can occur. This is explained with reference to FIG. 10. The top graph shows the timing of illumination of an even row and the bottom graph shows the timing of illumination of an adjacent odd row.

At the times shown by the arrows, adjacent odd and even lines will display video from different frames at the same time. Therefore, the interlaced scrolling bar is preferably used with low-duty cycle driving schemes (with a duty cycle less than 50%).

Another drawback of interlaced driving schemes is the appearance of line crawl. This results when adjacent rows display information from different frames. Low duty cycles and motion compensation reduce this drawback.

This effect is particularly visible in matrix displays because the pixels are defined very sharply.

A further modification to the interlaced scheme described above, in order to eliminate line crawl, is to use an interlaced scheme with double line addressing. In this case, each band includes all adjacent rows (rather than only the odd or even rows) but each band is addressed twice with data from the same frame. Instead of addressing only the even or odd lines, an even and an adjacent odd line are addressed simultaneously and with the same data. The effect is that there are no black lines between addressed lines. However, as data in even and odd frames is not the same, even for still pictures (they are temporarily spaced ½ line apart), the resulting image is not completely steady. This only works when the duty cycle is short, to provide a gap between the even and odd frames.

Apart from a peak brightness reduction (two lines generate light instead of one), the temporal response will be as in the case of the interlaced driving scheme shown in FIG. 9.

The relation between input video, and the displaying of the video will be analogue to FIG. 8, except for a difference in duty cycle of a factor 2 (now, all lines in each bar generate light). This means the perceived temporal refresh rate is doubled. However, an obvious disadvantage is a loss of resolution. In particular, two lines are addressed with the same data in each cycle. This requires (trivial) modifications to the display. The number of address actions remains the same, but twice as many lines are addressed. The loss of resolution results because one frame is split into two fields, one with the even lines, and one with the odd lines. Each field thus contains only half the information. These two fields are shown sequentially, and the complete image is integrated in the eye to one image. When viewing one specific line, the correct data which was present in one field of the image is integrated by the eye with data that was interpolated from a neighboring line in the other field.

The lines that are active and consequently drawing current from the power line vary for the different addressing schemes. This will have an influence on the voltage drop over the power line.

Figure 11:
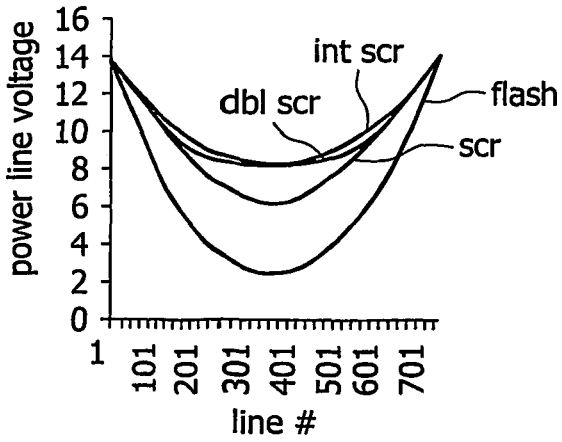
FIG. 11 is a graph used to explain the benefits of the techniques of the invention.

FIG. 11 shows the power line voltage for four different addressing schemes: flashing ("flash"), scrolling bar ("scr"), double scrolling ("dbl scr") and interlaced scrolling ("int scr"). The voltage is averaged over one frame period. The duty cycle is 50% and the power supply voltage is 15 V.

The addressing scheme of the invention is particularly beneficial for vertical power lines, and FIG. 11 assumes vertical power lines are used.

For obvious reason, the greatest voltage drop occurs at the centre of the power line. The flashing addressing scheme has the largest voltage drop because all pixels draw current simultaneously in this scheme. The voltage drop is reduced for the scrolling bar scheme and even further for the double and interlaced scrolling bar schemes. For the scrolling bar, only a fraction of the rows (duty cycle*number of lines) draw current simultaneously, resulting in a smaller voltage drop at each time instant. In the interlaced scrolling bar and double scrolling schemes the drawn current is distributed over the upper and lower screen half. Since the power line is connected at both sides, the voltage drop is reduced even further.

FIG. 12 shows the maximum voltage drop along a vertical power line for varying screen size (FIG. 12 (*a*)) and duty cycle (FIG. 12(*b*)). The same terminology has been used as in FIG. 11.

For screen size, the voltage drop increases for larger screen sizes for all addressing schemes, although the invention does provide some improvement when implementing large screen sizes.

For duty cycle, the limit is the voltage drop at a duty cycle at 100% (i.e. 1) For low duty cycles the voltage drop increases rapidly in the flashing scheme, while it remains nearly constant for the double and interlaced scrolling schemes. Therefore, the double bar addressing scheme enables low duty cycle driving of AMPLED displays.

FIG. 13 shows a possible display system that implements the double bar addressing schemes. A display controller 20 stores the input video data in a frame buffer 22 and controls the row driver 8 and column driver 9 that drive the display. The displayed data is supplied to the column driver 9 through the frame buffer 22.

FIG. 14 and FIG. 15 explain the reading and writing of data in the frame buffer 22. The frame buffer memory is divided in two areas: one for the odd numbered frames and one for the even numbered frames. The hatched areas in the figure indicate the data that is not displayed yet. Both bars have a separate read pointer which point to data from separate frames, and these are separated by half the buffer height. The write pointer moves with twice the velocity of the read pointers (denoted $V_W$ and $V_R$ in FIG. 14). When a read pointer reaches the last image data for one frame, it jumps to the new starting position of the correct frame, which has just filled with the new data.

Since at each time instant, the total amount of data that should still be displayed is less than one frame memory, only one frame buffer is needed. The frame buffer is already available in existing display designs.

FIG. 15 shows in more detail the process of writing and reading data in the frame buffer memory, and shows three time instants. In FIG. 15(1), the write pointer starts writing new data in the frame buffer F0. The even read pointer then starts reading data from this buffer. The odd read pointer still reads data from the last buffer F-1, which is already completely filled. In FIG. 15(2), the write pointer is still writing data in the even frame buffer and both read pointers read available data. In FIG. 15(3), the even read pointer has finished reading buffer F-1 and jumps to the new buffer, where the first line has just been written by the write pointer.

As mentioned above, the total amount of memory space needed is only for one frame of data, and this memory space is written to cyclically by the write pointer.

In all examples above, a two bar scrolling scheme has been described. It should be noted that the invention could be extended to more scrolling bars.

The specific pixel configuration for the display device has not been described, but this will be routine to those skilled in the art.

Other modifications will be apparent to those skilled in the art.

The invention claimed is:

1. A method of illuminating an active matrix electroluminescent display device comprising an array of display pixels arranged in rows and columns, the method comprising acts of:

at any point in time:

forming at least two scrolling bands of a plurality of simultaneously illuminated rows o pixels;

forming a second scrolling band of a plural of non-illuminated rows of pixels for separating the at least two bands;

scrolling the at least two bands in the column direction over time such that they simultaneously change horizontal position from one time to a next time; and displaying image data for different frames of video in different of the at least two bands so that different parts of two adjacent frames are displayed at any one time, wherein not more than 75% of the rows of pixels are illuminated at any point in time.

2. The method as claimed in claim 1, wherein each of the at least two bands comprises a plurality of adjacent rows of pixels.

3. The method as claimed in claim 1, wherein each of the at least two bands comprise a plurality of sequential alternate row of pixels.

4. The method as claimed in claim 3, wherein one of the at least two bands comprises only odd rows and another of the at least two bands comprises only even rows.

5. The method as claimed in claim 1 wherein at most 50% of the rows are illuminated at any point in time.

6. The method as claimed in claim 5, wherein at most 30% of the rows are illuminated at any point in time.

7. An active matrix electroluminescent display device comprising:

an array of display pixels arranged in rows and columns; and row driver circuitry for forming at least two scrolling bands of a plurality of simultaneously illuminated rows of pixels, forming a second scrolling band of a plurality of non-illuminated rows of pixels for separating the at least two bands, the row driver circuitry illuminating each row of pixels for not more than 75% of a frame period, wherein the at least two bands scroll in the column direction over time such that they simultaneously change horizontal position from one time to a next time, and image data for different frames of video is displayed in different ones of the at least two bands so that different parts of two adjacent frames are displayed at any one time.

8. The device as claimed in claim 7, further comprising a frame buffer for storing image data.

9. The device as claimed in claim 8, wherein the frame buffer stores an amount of data corresponding to a single frame of the image data.

10. The device as claimed in claim 9, wherein the image data is written into the frame buffer progressively frame by frame in sequence, such that the frame buffer stores partial image data for two adjacent frames, and wherein the image data is read out from the frame buffer at two locations simultaneously.

11. The device as claimed in claim 10, wherein the two locations include image data from different adjacent frames of image data.

* * * * *